US006350165B1

(12) United States Patent
Neisen

(10) Patent No.: US 6,350,165 B1
(45) Date of Patent: Feb. 26, 2002

(54) MARINE STERN DRIVE TWO-SPEED TRANSMISSION

(75) Inventor: Gerald F. Neisen, Rockport, TX (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/598,207

(22) Filed: Jun. 21, 2000

(51) Int. Cl.[7] ..... B63H 5/125
(52) U.S. Cl. ..... 440/75
(58) Field of Search ..... 440/900, 75, 83; 475/220, 230, 269, 302, 306, 311, 323, 317, 224, 316, 257

(56) References Cited

U.S. PATENT DOCUMENTS

| | | | | |
|---|---|---|---|---|
| 3,919,964 | A | | 11/1975 | Hagen |
| 3,977,356 | A | | 8/1976 | Kroll |
| 3,994,254 | A | | 11/1976 | Woodfill |
| 4,276,034 | A | | 6/1981 | Kashmerick |
| 4,395,240 | A | | 7/1983 | Blanchard |
| 4,397,198 | A | | 8/1983 | Borgersen et al. |
| 4,428,734 | A | | 1/1984 | Ludlow |
| 4,451,238 | A | | 5/1984 | Arnold |
| 4,558,769 | A | | 12/1985 | Neisen |
| 4,820,209 | A | | 4/1989 | Newman |
| 4,829,846 | A | | 5/1989 | DeSalvo et al. |
| 4,850,911 | A | | 7/1989 | Nakahama et al. |
| 4,861,295 | A | | 8/1989 | McElroy, Jr. et al. |
| 4,863,406 | A | | 9/1989 | Bland et al. |
| 4,867,717 | A | | 9/1989 | Burmeister et al. |
| 4,887,984 | A | | 12/1989 | Newman |
| 4,919,009 | A | | 4/1990 | Newman et al. |
| 4,969,370 | A | | 11/1990 | Hayasaka |
| 5,018,996 | A | | 5/1991 | Newman et al. |
| 5,108,324 | A | | 4/1992 | Adams et al. |
| 5,564,992 | A | * | 10/1996 | Cunningham ..... 475/257 |
| 5,711,742 | A | | 1/1998 | Leinonen et al. |
| 5,836,067 | A | | 11/1998 | Cochran |
| 6,027,424 | A | * | 2/2000 | Reynolds ..... 475/316 |

* cited by examiner

*Primary Examiner*—Ed Swinehart
(74) *Attorney, Agent, or Firm*—Timothy J. Ziolkowski; Cook & Franke SC

(57) ABSTRACT

An inboard/outboard powered watercraft (10) incorporating a transmission (30, 80) in its vertical drive unit (24) for providing two forward speeds plus reverse. The transmission is packaged to fit within the vertical drive unit (24) by incorporating a bevel gear apparatus (44, 120). In one embodiment, the transmission (30) also includes a planetary gear apparatus (46) together with two hydraulic clutches (70, 72) and a ring gear brake (56). In a second embodiment, three hydraulic clutches (98, 100, 114) are utilized with bevel gears (94,96,106,110,112) alone to provide the two forward and reverse speeds.

16 Claims, 5 Drawing Sheets

MARINE STERN DRIVE TWO-SPEED TRANSMISSION

BACKGROUND OF THE INVENTION

The present invention relates generally to the field of watercraft, and more particularly to the field of marine propulsion systems, and specifically to a transmission having two forward speeds and reverse for an inboard/outboard stern drive watercraft.

In conventional single speed marine drives, an engine is mechanically coupled to a propeller either directly or through a gearbox to provide a single gearing ratio. It is known that a single gear ratio connection between the engine and propeller will provide less than optimal performance for many applications. There have been efforts to improve the performance of marine propulsion systems by the use of multi-speed and hydraulically coupled transmissions. It is known that the performance of a watercraft may be improved by providing a higher gear ratio connection between the engine and the propeller for low speed operation and acceleration, and by providing a direct drive or overdrive gear ratio between the engine and the propeller for high speed operation. In this manner, the engine may be operated at a point closer to its peak power output during a wider range of operating conditions.

U.S. Pat. No. 5,711,742 issued on Jan. 27, 1998, to Leinonen, et. al., incorporated by reference herein, describes a multi-speed marine propulsion system with an automatic shifting mechanism. An automatic transmission is interposed between the engine and the inboard/outboard drive apparatus. Although providing improved performance when compared to prior art single speed propulsion systems, the device of Leinonen creates an excessively long driveline that necessitates the placement of the engine in a more forward position within the watercraft hull than may otherwise be desirable.

U.S. Pat. No. 4,820,209 issued on Apr. 11, 1989, to Newman, incorporated by reference herein, describes a marine propulsion system having a fluid coupling with a variable power output. While this system avoids the long driveline of the Leinonen apparatus, it does so at the expense of multi-speed forward gear ratios. In lieu of multi-speed gears, the device of Newman provides for a controlled slippage between the engine and the propeller in order to improve low speed watercraft operation. The hydraulic coupling and forward-reverse gearing of the Newman transmission are enclosed within a housing passing through the transom of the watercraft, which in turn connects to the vertical drive unit containing the propeller. The device of Newman fails to provide a direct mechanical connection between the engine and the propeller at a plurality of forward gear ratios.

BRIEF SUMMARY OF THE INVENTION

Thus, there is a particular need for an improved multi-speed mechanical drive transmission for a stern drive watercraft. Accordingly, a transmission for a watercraft is described herein as including: a generally horizontal input shaft rotatably supported by the vertical drive unit housing and adapted for coupling to an engine output shaft of the watercraft; a generally vertical output shaft rotatably supported by the vertical drive unit housing and adapted for coupling to a propeller gear apparatus; a bevel gear apparatus selectively connectable between the input shaft and the output shaft in one of a high forward, reverse and neutral positions for providing a high forward ratio of rotation between the input shaft and the output shaft, a reverse ratio of rotation between the input shaft and the output shaft, and neutral connection between the input shaft and the output shaft respectively; a planetary gear apparatus having a sun gear connected for rotation with a portion of the bevel gear apparatus, a planet gear having an axis of rotation connected for rotation with the output shaft, and a ring gear; a brake selectively connected between the vertical drive unit housing and the ring gear, the brake having an engaged position for providing a low forward ratio of rotation between the input shaft and the output shaft and a disengaged position for allowing independent rotation of the sun gear and the planet gear.

In another embodiment, a transmission for a stern drive watercraft is described herein, the stern drive having a vertical drive unit housing disposed rearward of a transom of the watercraft, the transmission including: a generally horizontal input shaft rotatably supported by the vertical drive unit housing and adapted for coupling to an engine output shaft of the watercraft; a generally vertical output shaft rotatably supported by the vertical drive unit housing and adapted for coupling to a propeller gear apparatus; and a bevel gear apparatus selectively connectable between the input shaft and the output shaft for alternatively providing a first forward gear ratio connection, a second forward gear ratio connection, a reverse gear ratio connection, and a neutral connection between the input shaft and the output shaft.

BRIEF DESCRIPTION OF THE DRAWINGS

The features and advantages of the present invention will become apparent from the following detailed description of the invention when read with the accompanying drawings. Similar parts appearing in multiple figures may be numbered consistently among the figures, in which.

DETAILED DESCRIPTION OF THE INVENTION

Figure 1:
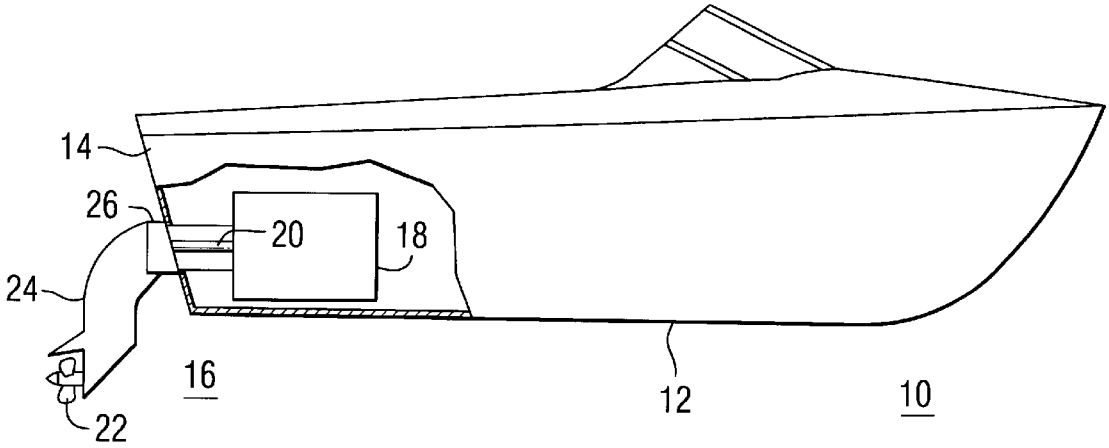
FIG. 1 is a partial cross-sectional view of a watercraft having a stern drive apparatus.

A watercraft 10 is illustrated in FIG. 1 as having a hull 12 including a transom 14 forming the rearward portion of the watercraft 10. The watercraft 10 is powered by a marine propulsion apparatus 16 including an engine 18 disposed within the hull 12. Engine 18 may be any known type such as a gasoline or diesel engine. Engine 18 includes an output shaft 20 for conveying mechanical energy to a propeller 22 through a vertical drive unit 24 rotatably and pivotally connected to a gimbal housing 26. This style of marine propulsion apparatus 16 is known in the art as an inboard/outboard drive unit. The vertical and horizontal drive axes of the propeller 22 may be adjusted by pivoting/rotating the vertical drive unit 24 relative to the gimbal housing 26. As will be described more fully with regard to FIG. 2 and FIG. 3, the vertical drive unit 24 utilizes a combination of bevel gears and clutches so that the ration of the speed of rotation of propeller 22 with respect to the speed of rotation of output shaft 20 may be selected to be one of two forward drive ratios, a reverse ratio, or a neutral ratio. The inventor has found that the use of bevel gears and clutches will facilitate the packaging of a multi-speed transmission to be small enough to fit within the confines of a standard vertical drive unit. By including the necessary gearing for two forward speeds and reverse within the vertical drive unit 24, the applicant has avoided many of the disadvantages of prior art multi-speed marine transmissions.

Figure 2:
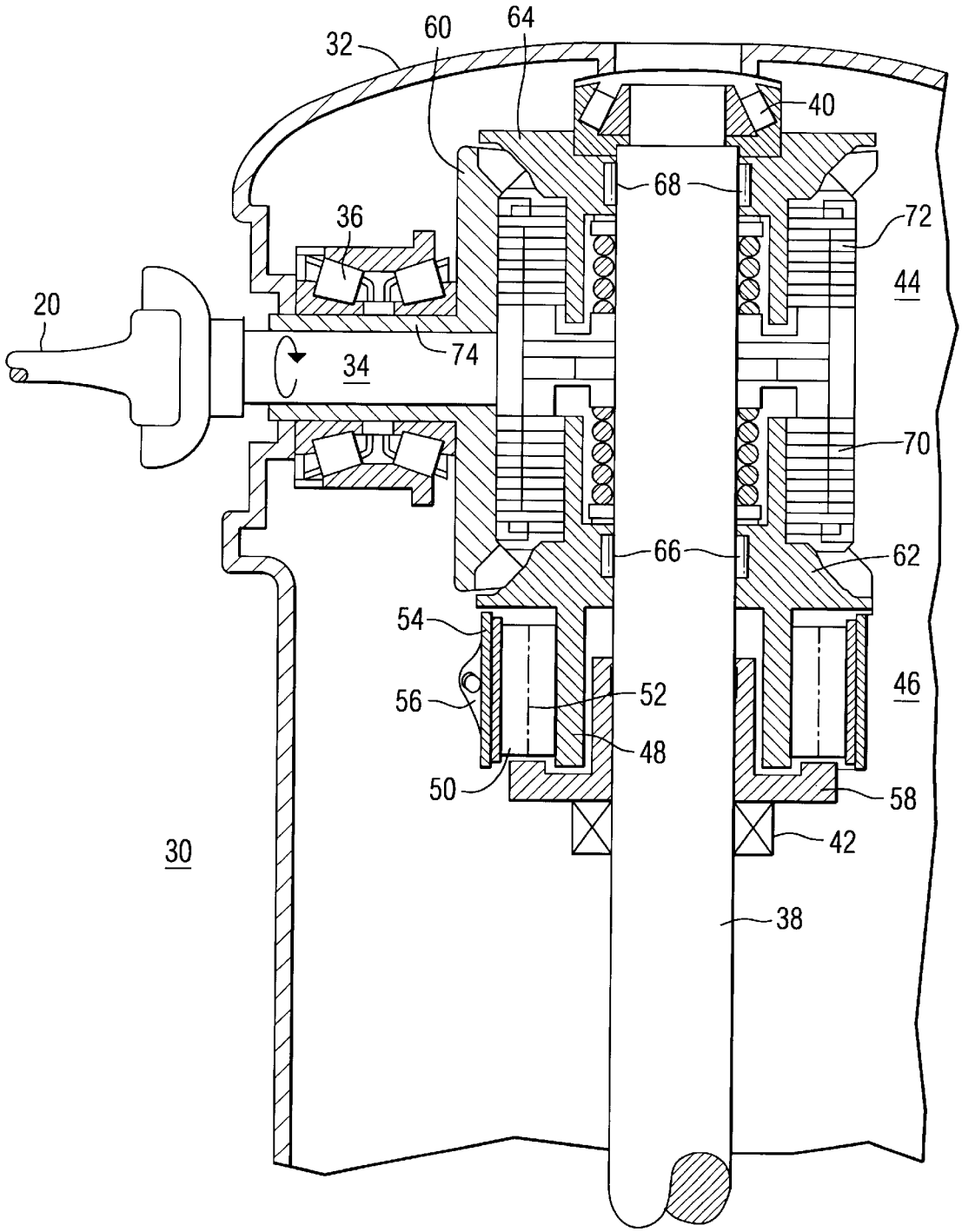
FIG. 2 is a cross-sectional view of a first embodiment of a bevel gear transmission disposed in the vertical drive unit of the watercraft of FIG. 1.

FIG. 2 illustrates one embodiment of a transmission 30 that may be used in stern drive watercraft 10. The transmission 30 includes a housing 32 which may form at least part of the vertical drive unit 24 of watercraft 10. Transmission 30 includes an input shaft 34 coupled to the engine output shaft 20. Input shaft 34 is rotatably supported by one or more thrust bearings 36 for rotation relative to housing 32. Transmission 30 further includes a generally vertical output shaft 38 rotatably supported within housing 32 by bearings 40, 42. Output shaft 38 is adapted for coupling to propeller 22 through a propeller gear apparatus as is known in the art for translating the vertical rotation of output shaft 38 into the horizontal rotation of propeller 22. Although input shaft 34 is illustrated as being generally horizontal and output shaft 38 as being generally vertical, one may appreciate that in other embodiments the components of transmission 30 may be disposed in other orientations as may be appropriate for the particular application.

Transmission 30 utilizes the combination of a bevel gear apparatus 44 and a planetary gear apparatus 46 to provide a compact multi-speed drive mechanism. Bevel gear apparatus 44 is selectively connectable between the input shaft 34 and the output shaft 38 in any one of a high forward, reverse, and neutral positions for providing a high-forward ratio of rotation between the input shaft 34 and the output shaft 38, a reverse ratio of rotation between the input shaft 34 and the output shaft 38, and a neutral connection between the input shaft 34 and output shaft 38 respectively. The term neutral connection is used herein to describe a neutral gear where no power is transmitted between the input shaft 34 and the output shaft 38, and wherein those two shafts are free to rotate independent of each other. The planetary gear apparatus 46 includes a sun gear 48 connected for rotation with a portion of the bevel gear apparatus 44, a planet gear 50 having an axis of rotation 52 connected for rotation with the output shaft 38, and a ring gear 54. Planetary gear apparatus 46 may include one or a plurality of planet gears 50, each having an axis of rotation 52 supported by a carrier 58. Carrier 58 is in splined connection with output shaft 38 for concentric rotation therewith. Transmission 30 also includes a brake 56 selectively connected between the vertical drive unit housing 32 and the ring gear 54. The brake 56 may be any style known in the art for use with ring gears, and has an engaged position for preventing the rotation of ring gear 54 relative to housing 32 and a disengaged position for allowing ring gear to rotate.

Input shaft 34 is driven by drive shaft 20 to rotate with engine 18. In one embodiment, the speed of rotation of input shaft 34 will be the same as the speed of rotation of engine 18. However, one may envision applications wherein a speed reducer or overdrive mechanism may be interposed between the engine 18 and transmission input shaft 34. An input bevel gear 60 is in splined connection with input shaft 34 for concentric rotation therewith. Input bevel gear 60 forms a portion of the bevel gear apparatus 44, together with a forward bevel gear 62 and a reverse bevel gear 64. Forward bevel gear 62 and reverse bevel gear 64 are rotatably supported to be concentric with output shaft 38 by bearings 66, 68 respectively. Forward bevel gear 62 is engaged with a first portion of input bevel gear 60 for rotation in a forward direction therewith. Reverse bevel gear 64 is engaged with a second portion of input bevel gear 60 on an opposed side of input bevel gear 60 from forward bevel gear 62. Accordingly, reverse bevel gear 64 is engaged for rotation in a reverse direction with input bevel gear 60. Forward bevel gear 62 and reverse bevel gear 64, forming a further portion of bevel gear apparatus 44, will be in rotation coincident with input shaft 34 and engine 18. The relative speeds of rotation of forward bevel gear 62 and reverse bevel gear 64 will be a function of the diameter of each of these respective gears and the diameter of the input bevel gear 60. Sun gear 48 is attached to, and preferably formed to be integral with the forward bevel gear 62 for concentric rotation therewith.

Transmission 30 further includes a forward clutch 70 connected between the forward bevel gear 62 and the output shaft 38 for selectively connecting the output shaft 38 for forward rotation with the forward bevel gear 62. A reverse clutch 72 is connected between the reverse bevel gear 64 and the output shaft 38 for selectively connecting the output shaft 38 for reverse rotation with the reverse bevel gear 64. Clutches 70, 72 may be any style known in the art, and may be preferably hydraulically operated clutches, such as for example the Hydra Series provided by Yamaha Motor Corporation. Pressurized hydraulic fluid for the operation of the clutches 70, 72 may be provided by a pump (not shown) driven by any of the components of transmission 30 that rotate coincident with engine 18, or by a pump connected directly to the engine 18 such as a power steering pump.

Transmission 30 may be operated in a first forward (low) gear ratio mode by disengaging forward clutch 70 and reverse clutch 72 and engaging brake 56. In this mode, output shaft 38 will be free to rotate independent of forward bevel gear 62 and reverse bevel gear 64. The forward rotation of sun gear 48 together with forward bevel gear 62 will result in the forward rotation of carrier 58 and its attached output shaft 38 through the action of the planetary gear assembly 46. The relative speeds of rotation of sun gear 48 and output shaft 38 (i.e. plant gear carrier 58) will depend upon the relative sizes of the sun gear 48, planet gear 50 and ring gear 54. In one embodiment, the gear ratio provided by such an arrangement may be 1.33:1 lower than that provided by a standard forward single speed transmission. Transmission 30 may be shifted to a second (high) gear ratio mode by disengaging brake 56 and engaging forward clutch 70, while reverse clutch 72 remains disengaged. In this mode, output shaft 38 will rotate together with forward bevel gear 62 at a speed determined by the relative diameters of forward bevel gear 62 and input bevel gear 60. Sun gear 48 and carrier 58 are thereby caused to rotate together, and will accordingly cause the rotation of ring gear 54. A reverse gear ratio mode of operation may be achieved with transmission 30 by engaging reverse clutch 72 and disengaging forward clutch 70 with brake 56 being disengaged. In this mode, output shaft 38 will rotate together with reverse bevel gear 64. The resulting counter-rotation of carrier 58 and sun gear 48 will then be accommodated by the free turning of ring gear 54. The speed of reverse rotation of output shaft 38 will be a function of the relative diameters of input bevel gear 60 and reverse bevel gear 64.

One may appreciate that the size of transmission 30 may be minimized by arranging its various components as illustrated in FIG. 2. In particular, having the output shaft 38 disposed to have its axis of rotation being perpendicular to the axis of rotation of input shaft 34 is conducive to a layout wherein input bevel gear 60 is concentric with input shaft 34 while forward bevel gear 62 and reverse bevel gear 64 are each concentric with output shaft 38 and are disposed at respective locations on the output shaft 38 corresponding to the diameter of the input bevel gear 60. This layout provides a volume between the forward bevel gear 62 and the reverse bevel gear 64 for locating the forward clutch 70 and reverse clutch 72, each having an axis of rotation concentric with the output shaft 38. Furthermore, forming the sun gear 48 as an extension of the forward bevel gear 62 and disposing sun gear 48 to be concentric with the output shaft 38 on a side of the forward bevel gear 62 opposed the reverse bevel gear 64 allows the planetary gear apparatus 46 may be located proximate the bevel gear apparatus 44. Support of output shaft 38 is accomplished by having a thrust bearing 40 located at an end of output shaft 38 above reverse bevel gear 64, and by having a roller or ball bearing 42 located proximate the carrier 58. An extension 74 of input bevel gear 60 is supported by one double-thrust bearing 36. Thus, a robust, compact package is provided for connecting perpendicular input and output shafts in any of two forward speed ratios or a reverse speed ratio.

Figure 3:
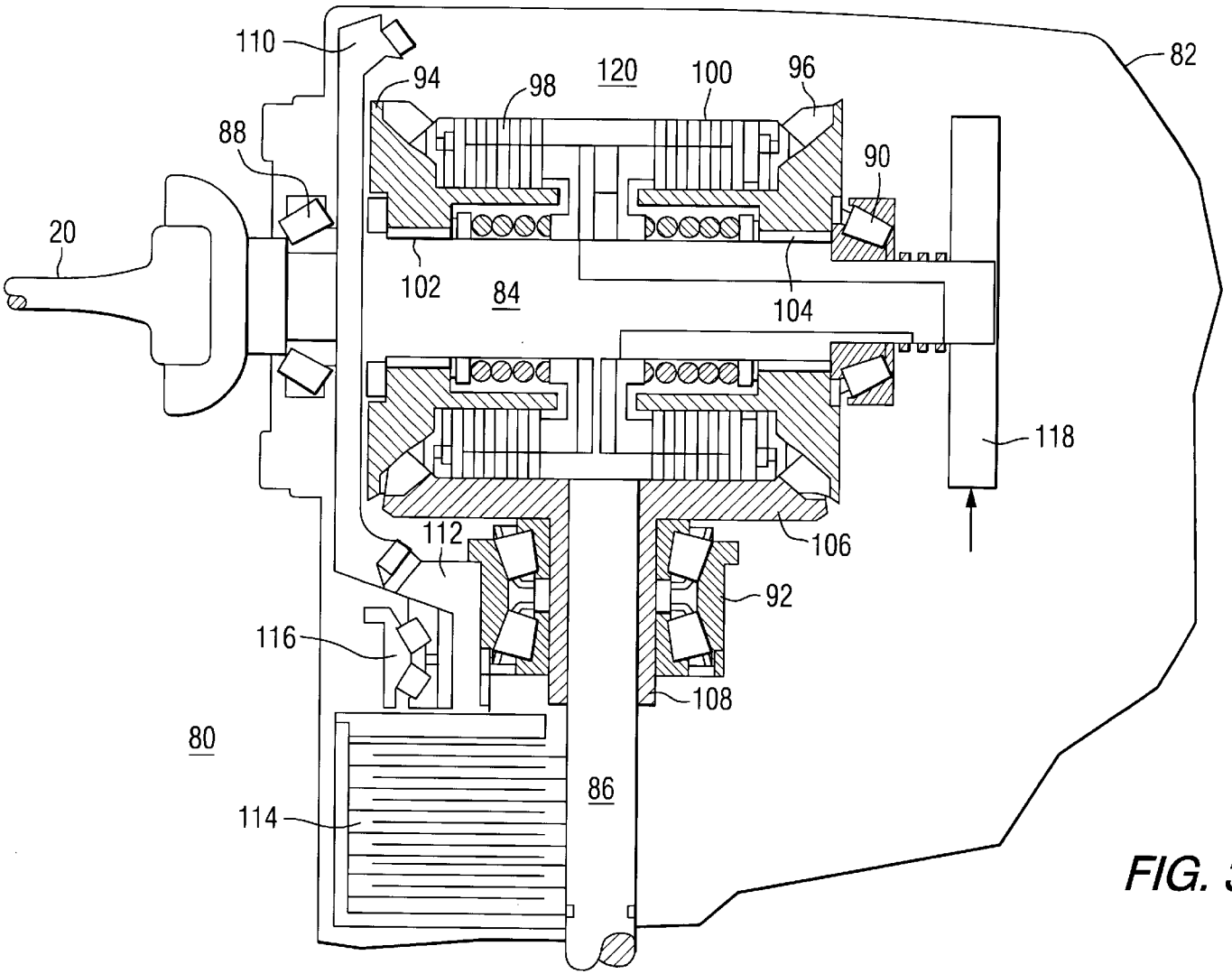
FIG. 3 is a cross-sectional view of a second embodiment of a bevel gear transmission disposed in the vertical drive unit of the watercraft of FIG. 1.

FIG. 3 illustrates a partial cross-sectional view of another embodiment of a bevel gear transmission 80 as may be used in the marine propulsion apparatus 16 of watercraft 10. Transmission 80 includes a housing 82 rotatably supporting an input shaft 84 and an output shaft 86 through respective bearings 88, 90, 92. Input shaft 84 is connected to engine output shaft 20. Input shaft 84 may be selectively connected to first forward bevel gear 94 or reverse bevel gear 96 by the operation of the respective first forward clutch 98 or reverse clutch 100. First forward bevel gear 94 and reverse bevel gear 96 are rotatably supported for concentric rotation about input shaft 84 by respective bearing assemblies 102, 104. A first output bevel gear 106 is in splined connection for concentric rotation with output shaft 86. First output bevel gear 106 is engaged on a first side with first forward bevel gear 94 and on an opposed side with reversed bevel gear 96. An extension 108 of first output bevel gear 106 is supported by thrust bearing 92 for corresponding support of output shaft 86. A second forward bevel gear 110 is in splined connection with input shaft 84 for concentric rotation therewith. Second forward bevel gear 110 may be selectively engaged with output shaft 86 through second output bevel gear 112 and clutch 114. Second output bevel gear 112 is formed to be concentric with output shaft 86 and is supported on one side by bearing 92 and on an opposed side by bearing 116.

The combination of first forward bevel gear 94, second forward bevel gear 110, second output bevel gear 112, and reverse bevel gear 96 constitute a bevel gear apparatus 120 selectively connectable between the input shaft 84 and the output shaft 86 for alternatively providing a first forward gear ratio connection, a second forward gear ratio connection, a reverse gear ratio connection, and a neutral connection between the input shaft 84 and the output shaft 86. To obtain the first forward (low) gear mode of operation, the first forward clutch 98 is engaged, and the reverse clutch 100 and second forward clutch 114 are disengaged. In this mode, first forward bevel gear 94 rotates with input shaft 84 and is engaged with first output bevel gear 106 to drive output shaft 86 in a forward direction. The ratio of the speeds of rotation between input shaft 84 and output shaft 86 is a function of the relative diameters of the first forward bevel gear 94 and the first output bevel gear 106. In one embodiment, this ratio may be 1.2/1. A second forward (high) gear ratio mode of operation may be obtained by disengaging first forward clutch 98 and reverse clutch 100 while engaging second forward clutch 114. In this mode of operation, second forward bevel gear drives second output bevel gear 112 in a forward direction to rotate output shaft 86 therewith at a ratio determined by the relative diameters of the second forward bevel gear 110 and the second output bevel gear 112. In one embodiment, this ratio may be an overdrive ratio of 0.74:1. Reverse operation of transmission 80 may be achieved by disengaging first forward clutch 98 and second forward clutch 114 while engaging reverse clutch 100. In this mode of operation, reverse bevel gear 96 is driven to rotate with input shaft 84, and is engaged to rotate first output bevel gear 106 and output shaft 86 in a reverse direction. The relative speeds of rotation of input shaft 84 and output shaft 86 will be a function of the respective diameters of reverse bevel gear 96 and first output bevel gear 106.

The bevel gear apparatus 120 of the embodiment of FIG. 3 is advantageously configured to provide a robust, compact, multi-speed transmission 80 adapted for use in a vertical drive unit 24 of an inboard/outboard marine propulsion unit 16. First forward bevel gear 94 and reverse bevel gear 96 are disposed for concentric rotation about input shaft 84 at a distance corresponding to the diameter of first output bevel gear 106. The space between first forward bevel gear 94 and reverse bevel gear 96 is advantageously utilized to locate first forward clutch 98 and reverse clutch 100. The desired greater diameter of second forward bevel gear 110 permits second output bevel gear 112 to be positioned below the first output bevel gear 106 and to be concentrically supported with output shaft 86 by bearing 92. Second forward clutch 114 may be positioned below second output bevel gear 112 along output shaft 86 in an area that is otherwise not utilized. In this manner, a two forward speed transmission 80 may be packaged in a housing 82 that is not substantially different in size than prior art single forward speed vertical drive units.

Figure 5:
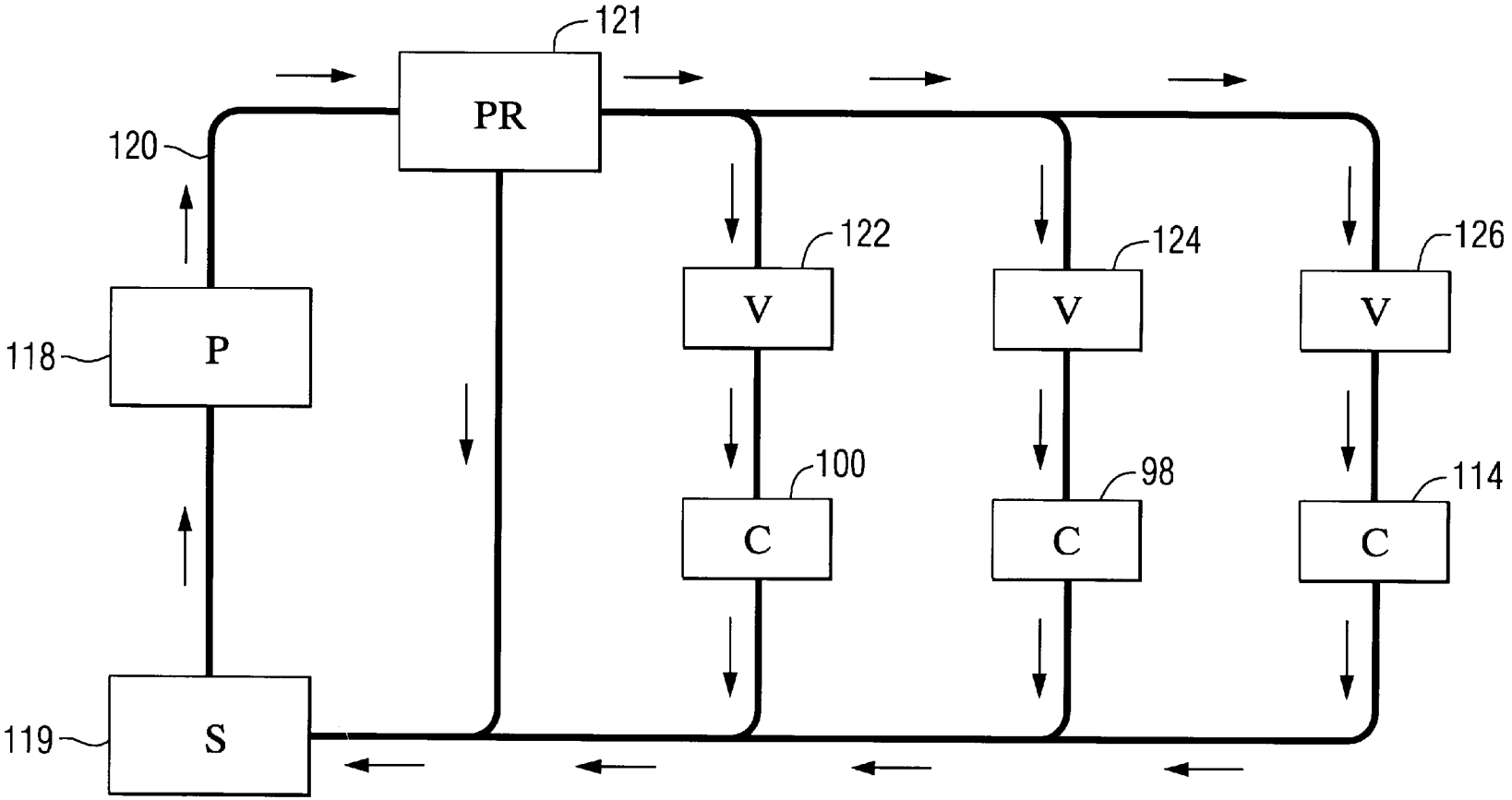
FIG. 5 is a schematic flow diagram for the pressurized hydraulic system of the transmission of FIG. 3.

Clutches 98, 100, 114 may be any style known in the art and may preferably be hydraulic clutches. Pressurized hydraulic fluid may be provided for the operation of the clutches and for the lubrication of the various parts of transmission 80 by an oil pump 118 connected to input shaft 84. As shown in schematic flow diagram FIG. 5, oil pump 118 may draw hydraulic fluid from a sump 119 and may have an output 120 connected to a plurality of control valves 122, 124, 126 for the control of respective clutches 98, 96, 114. A pressure regulator 121 may be used to limit and/or control the pressure of the hydraulic fluid being supplied to the valves 122, 124, 126. In one embodiment, pressure regulator 121 is used in conjunction wet slip clutches, as are known in the art, to enhance control of the watercraft 10 during slow speed operation. This is accomplished by varying the hydraulic fluid pressure below a predetermined speed, such as 10 miles per hour, and/or below a predetermined engine speed, such as 1,000 revolutions per minute. In this embodiment, pressure regulator 121 may take the form of a plurality of relief valves, with a lower pressure relief valve (such as 200 psi) being made operable during periods of slow speed operation and a higher pressure relief valve (such as 1,000 psi) being made operable during normal periods of operation. For this example, a pressure regulator 121 may be connected in fluid communication between first forward clutch 98 and pump outlet 120. This feature improves control of the watercraft 10 during docking or other slow speed maneuvers. Any sudden acceleration will result in the clutch locking up at normal operating pressure.

Figure 4:
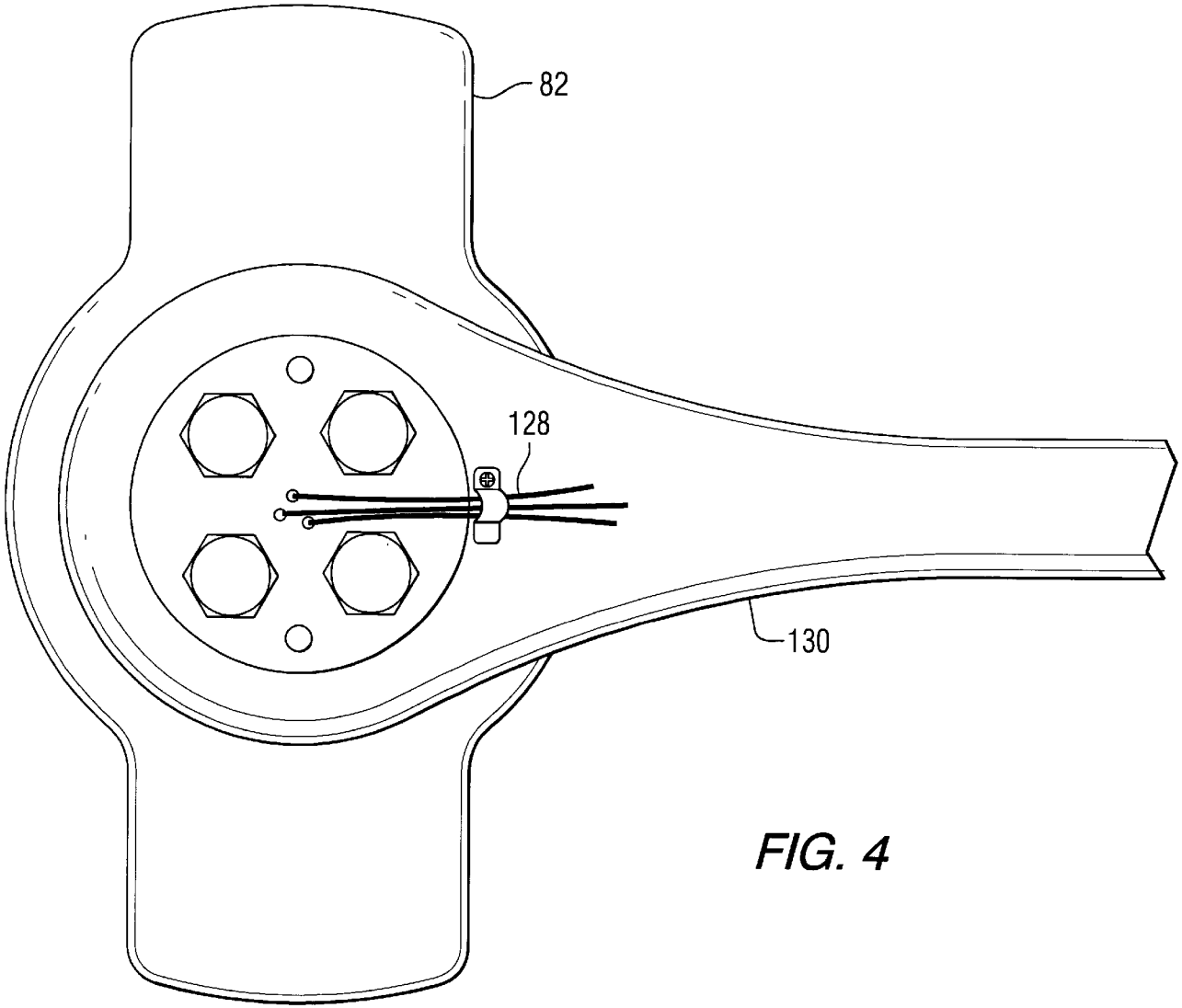
FIG. 4 is a top view of the steering arm of a marine propulsion unit illustrating the routing of control wiring.

The embodiment of FIG. 3 is particularly adapted for the use of a fly-by-wire control system. The term "fly-by-wire" is meant to describe a control system wherein the shifting of transmission 80 is accomplished by the electrical control of valves 122, 124, 126 without the need for a mechanical connection passing through housing 82. By using electrically controlled valves 122, 124, 126 such as solenoid valves or an electrically-driven rotary valve, the need for mechanical penetrations through housing 82 is eliminated. In one embodiment as illustrated in FIG. 4, the electrical wires used for controlling the position of valves 122, 124, 126 are routed out of housing 82 through the center line of a steering arm 130 attached to housing 82 along its vertical axis of rotation. By locating wires 128 along this axis of rotation, the flexing of the wires 128 during the steering of watercraft 10 is minimized.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A transmission for a stern drive watercraft, the stem drive having a vertical drive unit housing disposed rearward of a transom of the watercraft, the transmission comprising:

a generally horizontal input shaft rotatably supported by the vertical drive unit housing and adapted for coupling to an engine output shaft of the watercraft;

a generally vertical output shaft rotatably supported by the vertical drive unit housing and adapted for coupling to a propeller gear apparatus;

a bevel gear apparatus selectively connectable between the input shaft and the output shaft in one of a high forward, reverse and neutral positions for providing a high forward ratio of rotation between the input shaft and the output shaft, a reverse ratio of rotation between the input shaft and the output shaft, and neutral connection between the input shaft and the output shaft respectively;

a planetary gear apparatus having a sun gear connected for rotation with a portion of the bevel gear apparatus, a planet gear having an axis of rotation connected for rotation with the output shaft, and a ring gear;

a brake selectively connected between the vertical drive unit housing and the ring gear, the brake having an engaged position for providing a low forward ratio of rotation between the input shaft and the output shaft and a disengaged position for allowing independent rotation of the sun gear and the planet gear.

2. The transmission of claim 1, wherein the bevel gear apparatus further comprises:

an input bevel gear connected to the input shaft for rotation therewith;

a forward bevel gear engaged with a first portion of the input bevel gear for rotation in a forward direction therewith;

a reverse bevel gear engaged with a second portion of the input bevel gear for rotation in a reverse direction therewith.

3. The transmission of claim 2, further comprising:

a forward clutch connected between the forward bevel gear and the output shaft for selectively connecting the output shaft for forward rotation with the forward bevel gear; and a reverse clutch connected between the reverse bevel gear and the output shaft for selectively connecting the output shaft for reverse rotation with the reverse bevel gear.

4. The transmission of claim 3, wherein the planetary gear apparatus further comprises:

the sun gear being attached to the forward bevel gear for rotation therewith;

a carrier attached to the output shaft for rotation therewith;

the ring gear having an axis of rotation;

the planet gear engaged between the sun gear and the ring gear and having an axis of rotation attached to the carrier for rotation therewith.

5. A transmission comprising:

an input shaft;

an output shaft;

an input bevel gear connected to the input shaft for rotation therewith;

a forward bevel gear engaged with a first portion of the input bevel gear for rotation in a forward direction therewith;

a reverse bevel gear engaged with a second portion of the input bevel gear for rotation in a reverse direction therewith;

a forward clutch connected between the forward bevel gear and the output shaft for selectively connecting the output shaft for forward rotation with the forward bevel gear;

a reverse clutch connected between the reverse bevel gear and the output shaft for selectively connecting the output shaft for reverse rotation with the reverse bevel gear;

a sun gear attached to the forward bevel gear for rotation therewith;

a carrier attached to the output shaft for rotation therewith;

a ring gear having an axis of rotation;

at least one planetary gear engaged between the sun gear and the ring gear and having an axis of rotation attached to the carrier for rotation therewith;

a brake having a low gear position for preventing the rotation of the ring gear about its axis of rotation and having a high gear position for allowing the rotation of the ring gear about its axis of rotation.

6. The transmission of claim 5, further comprising:

the input shaft having an axis of rotation;

the output shaft having an axis of rotation disposed perpendicular to the axis of rotation of the input shaft axis of rotation;

the input bevel gear being concentric with the input shaft; and the forward bevel gear and the reverse bevel gear each being concentric with the output shaft and being disposed at respective locations on the output shaft corresponding to a diameter of the input bevel gear.

7. The transmission of claim 6, further comprising:

the sun gear being formed as an extension of the forward bevel gear and being disposed concentric with the output shaft on a side of the forward bevel gear opposed the reverse bevel gear.

8. The transmission of claim 6, further comprising the forward clutch and the reverse clutch each having an axis of rotation concentric with the output shaft and being disposed about the output shaft between the forward bevel gear and the reverse bevel gear.

9. The transmission of claim 5 further comprising:

a housing;

a first bearing rotatably supporting the output shaft with respect to the housing and disposed proximate the reverse bevel gear on a side of the reverse bevel gear opposed the forward bevel gear;

a second bearing rotatably supporting the output shaft with respect to the housing and disposed proximate the carrier on a side of the carrier opposed the forward bevel gear.

10. The transmission of claim 9, wherein the first bearing comprises a thrust bearing.

11. The transmission of claim 10, further comprising:

an extension of the input bevel gear extending about the input shaft in a direction opposed the forward bevel gear and the reverse bevel gear;

a thrust bearing rotatably supporting the extension of the input bevel gear with respect to the housing.

12. The transmission of claim 9, wherein the housing comprises a vertical drive unit of a marine stern drive apparatus.

13. The transmission of claim 5, further comprising a plurality of planetary gears engaged between the sun gear and the ring gear and each having an axis of rotation attached to the carrier for rotation therewith.

14. The transmission of claim 5, further comprising:

the input shaft having an axis of rotation;

the output shaft having an axis of rotation disposed perpendicular to the axis of rotation of the input shaft axis of rotation;

the input bevel gear having an axis of rotation concentric with the axis of rotation of the input shaft;

the forward bevel gear and the reverse bevel gear each having an axis of rotation concentric with the axis of rotation of the output shaft and being disposed at respective locations on the output shaft corresponding to a diameter of the input bevel gear;

the forward clutch and the reverse clutch each having an axis of rotation concentric with the output shaft and being disposed about the output shaft between the forward bevel gear and the reverse bevel gear;

the sun gear being formed as an extension of the forward bevel gear and disposed on a side of the forward bevel gear opposed the forward clutch.

15. A marine propulsion apparatus comprising:

an engine having an output shaft;

a gimbal housing connected to the engine and rotatably supporting a drive shaft connected to the engine output shaft, the gimbal housing adapted for passing through the transom of a watercraft;

a vertical drive unit rotatably and pivotally connected to the gimbal housing;

an input shaft rotatably supported by the vertical drive unit and connected to the drive shaft;

an output shaft rotatably supported by the vertical drive unit;

a propeller connected to the output shaft;

an input bevel gear connected to the input shaft for rotation therewith;

a forward bevel gear engaged with a first portion of the input bevel gear for rotation in a forward direction therewith;

a reverse bevel gear engaged with a second portion of the input bevel gear for rotation in a reverse direction therewith;

a forward clutch connected between the forward bevel gear and the output shaft for selectively connecting the output shaft for forward rotation with the forward bevel gear;

a reverse clutch connected between the reverse bevel gear and the output shaft for selectively connecting the output shaft for reverse rotation with the reverse bevel gear;

a sun gear attached to the forward bevel gear for rotation therewith;

a carrier attached to the output shaft for rotation therewith;

a ring gear having an axis of rotation;

at least one planetary gear engaged between the sun gear and the ring gear and having an axis of rotation attached to the carrier for rotation therewith;

a brake having a low gear position for preventing the rotation of the ring gear about its axis of rotation and having a high gear position for allowing the rotation of the ring gear about its axis of rotation.

16. A watercraft comprising:

a hull including a transom;

an engine disposed within the hull and having an output shaft;

a gimbal housing connected to the engine and rotatably supporting a drive shaft connected to the engine output shaft, the gimbal housing adapted for passing through the transom;

a vertical drive unit rotatably and pivotally connected to the gimbal housing;

an input shaft rotatably supported by the vertical drive unit and connected to the drive shaft;

an output shaft rotatably supported by the vertical drive unit;

a propeller connected to the output shaft;

an input bevel gear connected to the input shaft for rotation therewith;

a forward bevel gear engaged with a first portion of the input bevel gear for rotation in a forward direction therewith;

a reverse bevel gear engaged with a second portion of the input bevel gear for rotation in a reverse direction therewith;

a forward clutch connected between the forward bevel gear and the output shaft for selectively connecting the output shaft for forward rotation with the forward bevel gear;

a reverse clutch connected between the reverse bevel gear and the output shaft for selectively connecting the output shaft for reverse rotation with the reverse bevel gear;

a sun gear attached to the forward bevel gear for rotation therewith;

a carrier attached to the output shaft for rotation therewith;

a ring gear having an axis of rotation;

at least one planetary gear engaged between the sun gear and the ring gear and having an axis of rotation attached to the carrier for rotation therewith;

a brake having a low gear position for preventing the rotation of the ring gear about its axis of rotation and having a high gear position for allowing the rotation of the ring gear about its axis of rotation.

* * * * *